US007934548B2

(12) United States Patent
Doud et al.

(10) Patent No.: US 7,934,548 B2
(45) Date of Patent: May 3, 2011

(54) SPOOLED DEVICE RETAINING SYSTEM

(75) Inventors: Brian Doud, Spring, TX (US); John A. Thomas, Porter, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 79 days.

(21) Appl. No.: 12/426,392

(22) Filed: Apr. 20, 2009

(65) Prior Publication Data

US 2009/0260797 A1 Oct. 22, 2009

Related U.S. Application Data

(60) Provisional application No. 61/046,619, filed on Apr. 21, 2008.

(51) Int. Cl.
*E21B 19/10* (2006.01)

(52) U.S. Cl. ..... 166/250.01; 166/382; 166/75.11

(58) Field of Classification Search ..... 166/75.11, 166/77.2, 88.2, 250.01, 382
See application file for complete search history.

(56) References Cited

U.S. PATENT DOCUMENTS

| | | | |
|---|---|---|---|
| 4,372,706 | A | 2/1983 | Young |
| 4,498,563 | A | 2/1985 | Trahan |
| 4,577,687 | A | 3/1986 | Lanmon, II |
| 4,844,210 | A | 7/1989 | Wong |
| 6,543,546 | B2 * | 4/2003 | Kaiser ..... 166/382 |

* cited by examiner

*Primary Examiner* — William P Neuder
(74) *Attorney, Agent, or Firm* — Michael L. Flynn; David Hofman; Jody Lynn DeStefanis

(57) ABSTRACT

An embodiment of a system for preventing the loss of a spooled device into a wellbore comprises a housing defining an aperture extending therethrough, the aperture sized for allowing the spooled device to pass therethrough, a sensor to measure at least one condition of the system, and a gripper device to engage with the spooled device and the housing to prevent the loss of the spooled device when the condition of the system is a failure condition.

20 Claims, 3 Drawing Sheets

SPOOLED DEVICE RETAINING SYSTEM

CROSS-REFERENCE TO RELATED APPLICATION

This application is entitled to the benefit of, and/or claims priority to, provisional patent application 61/046,619 filed Apr. 21, 2008, the entire disclosure of which is incorporated herein by reference.

BACKGROUND

The statements in this section merely provide background information related to the present disclosure and may not constitute prior art. The system and method relate in general to cable systems and, in particular, to a system and apparatus for preventing the loss of a cable into a wellbore for use in the oilfield services industry.

Cable, typically composed of braided steel wire or the like, is used in a wide range of applications to support a load under tension. An application is in the oilfield services industry, where wireline tools, toolstrings or the like are lowered into a wellbore via a cable that is commonly referred to as wireline cable. The cable is supported and anchored by some other device such as a winch, drum or capstan and is routed from the winch, drum, or capstan, to other locations by sheaves. The cable typically has a finite load that it can support, generally indicated by its safe working load. The load capacity of the cable can decrease for several reasons and failure of the cable may occur if the load capacity is exceeded.

Failure of the cable results in loss of load support, where the cable will then move in a direction towards the load that the cable was supporting and may occur unexpectedly and possibly without warning. Once a failure has occurred, the cable typically accelerates very quickly. This is especially likely if the cable fails by separating into multiple pieces, where the initial tension and stretch of the cable prior to breaking results in storage of potential energy within the cable, which is converted to kinetic energy once the cable is separated. Failure in wireline applications may disadvantageously result in the cable entering the wellbore.

It is desirable, therefore, to provide a system and apparatus for preventing the loss of a cable into a wellbore.

SUMMARY

An embodiment of a system for preventing the loss of a spooled device into a wellbore, comprises a housing defining an aperture extending therethrough, the aperture sized for allowing the spooled device to pass therethrough, a sensor to measure at least one condition of the system, and a gripper device to engage with the spooled device and the housing to prevent the loss of the spooled device when the condition of the system is a failure condition. Alternatively, the system further comprises a controller for determining a failure condition of the system based on the measured system condition. The controller may compare the condition of the system with a threshold value to determine the failure condition. Alternatively, the gripper device is at least one wedge-shaped gripper for engaging with the interior surface of the housing and the exterior surface of the spooled device to applying a normal force to the spooled device. Alternatively, the system further comprises an actuator for applying a force to the gripper device to allow the gripper device to engage the spooled device and the housing. Alternatively, the system further comprises a release mechanism coupled to the gripper device to allow the gripper device to engage the spooled device and the housing.

Alternatively, the gripper device comprises a sacrificial material. Alternatively, the sensor measures a condition of the spooled device. The condition of the spooled device may be one of a tension of the spooled device, speed of the spooled device, and acceleration of the spooled device. Alternatively, the sensor measures a condition of auxiliary equipment for controlling the movement of the spooled device. The condition of auxiliary equipment may be one of a drum condition, a winch condition, and a surface equipment condition.

In an embodiment, a system for arresting the progress of a spooled device into a wellbore, comprises a housing defining an aperture extending therethrough, the aperture sized for allowing the spooled device to pass therethrough, a sensor to measure at least one condition of the system, a controller for determining a failure condition of the system based on the measured system condition, and a gripper device to engage with the spooled device and the housing to prevent the loss of the spooled device when the condition of the system is a failure condition. Alternatively, the controller compares the condition of the system with a threshold value to determine the failure condition. Alternatively, the gripper device is at least one wedge-shaped gripper for engaging with the interior surface of the housing and the exterior surface of the spooled device to apply a normal force to the spooled device.

Alternatively, the system further comprises an actuator for applying a force to the gripper device to allow the gripper device to engage the spooled device and the housing. Alternatively, the system further comprises a release mechanism coupled to the gripper device to allow the gripper device to engage the spooled device and the housing. Alternatively, the gripper device comprises a sacrificial material. Alternatively, the sensor measures a condition of the spooled device. The condition of the spooled device may be one of a tension of the spooled device, speed of the spooled device and acceleration of the spooled device. Alternatively, the sensor measures a condition of auxiliary equipment for controlling the movement of the spooled device. The condition of auxiliary equipment may be one of a drum condition, a winch condition, and a surface equipment condition.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
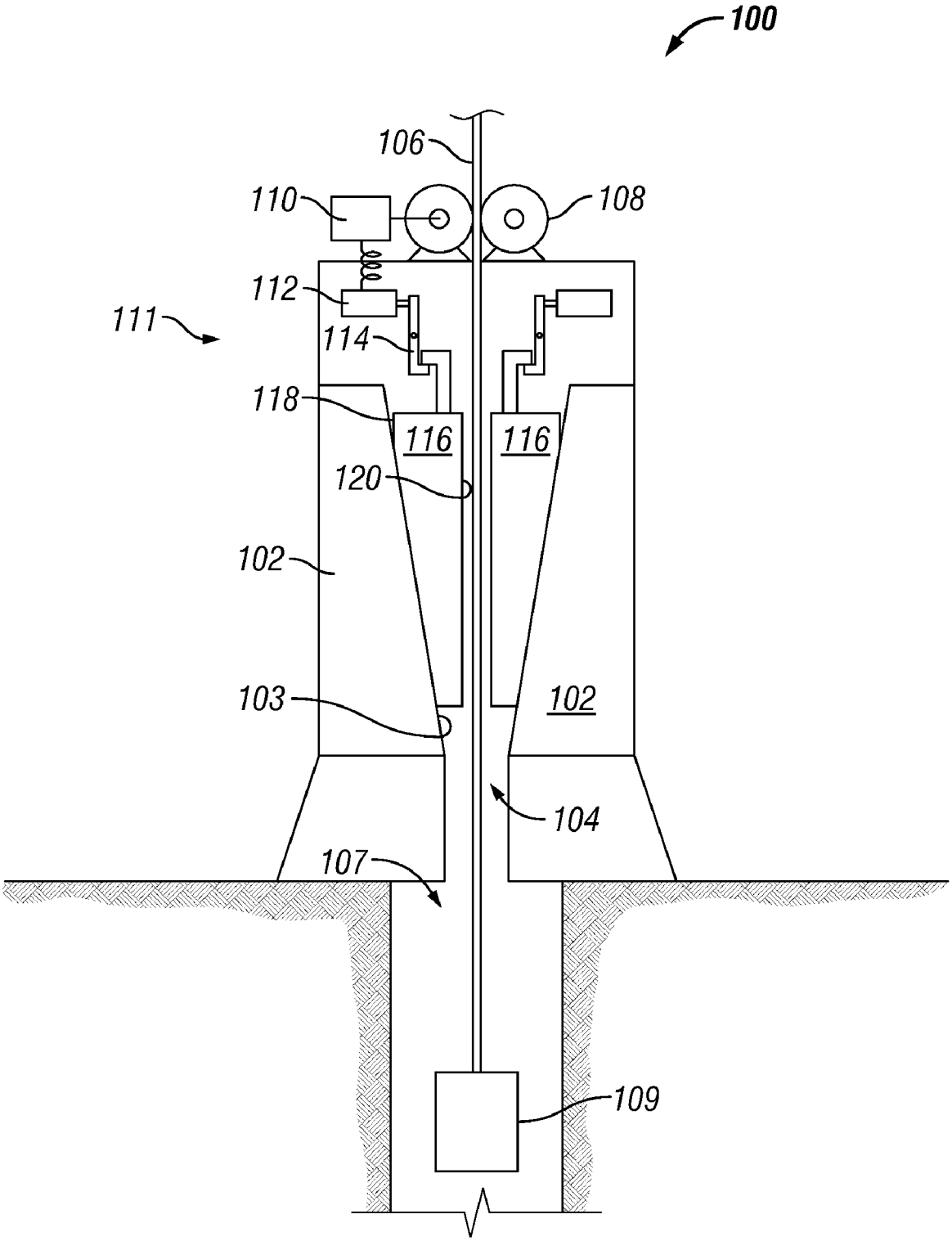
FIG. 1 is a schematic view of an embodiment of a spooled device retaining system shown in a rest position.

Referring now all of the Figures, an embodiment of a spooled device retaining system is indicated generally at 100. The system 100 is shown in a rest or unreleased position in FIG. 1 and in an engaged or released position In FIG. 2. The system 100 includes a housing 102 defining an aperture 104 extending therethrough. The aperture 104 is sized for allowing the passage of a spooled device 106 therethrough. The spooled device 106 may be a wireline cable, a slickline cable, or coiled tubing spooled on a reel or the like (not shown) for deployment into a wellbore, indicated generally at 107, as will be appreciated by those skilled in the art and may include a tool or toolstring 109 disposed on an end thereof. The system 100 includes at least one sensor, such as a wheel 108 that engages with the exterior surface of the wireline cable. The wheel 108 is in communication with an encoder 110, which is further connected to at release mechanism, indicated generally at 111, that comprises at least one solenoid 112 connected to a release arm 114. The release arm 114, in turn, engages with at least one wedge-shaped engaging device or gripper 116 disposed adjacent the housing 102, such as by a pivoting connection or the like. The grippers or wedge materials 116 have an exterior surface 118 that engages with the interior surface 103 of the housing 102 and an internal surface 120 that engages with the exterior surface of the spooled device 106 or cable when the system is in the engaged position of FIG. 2, discussed in more detail below.

Figure 2:
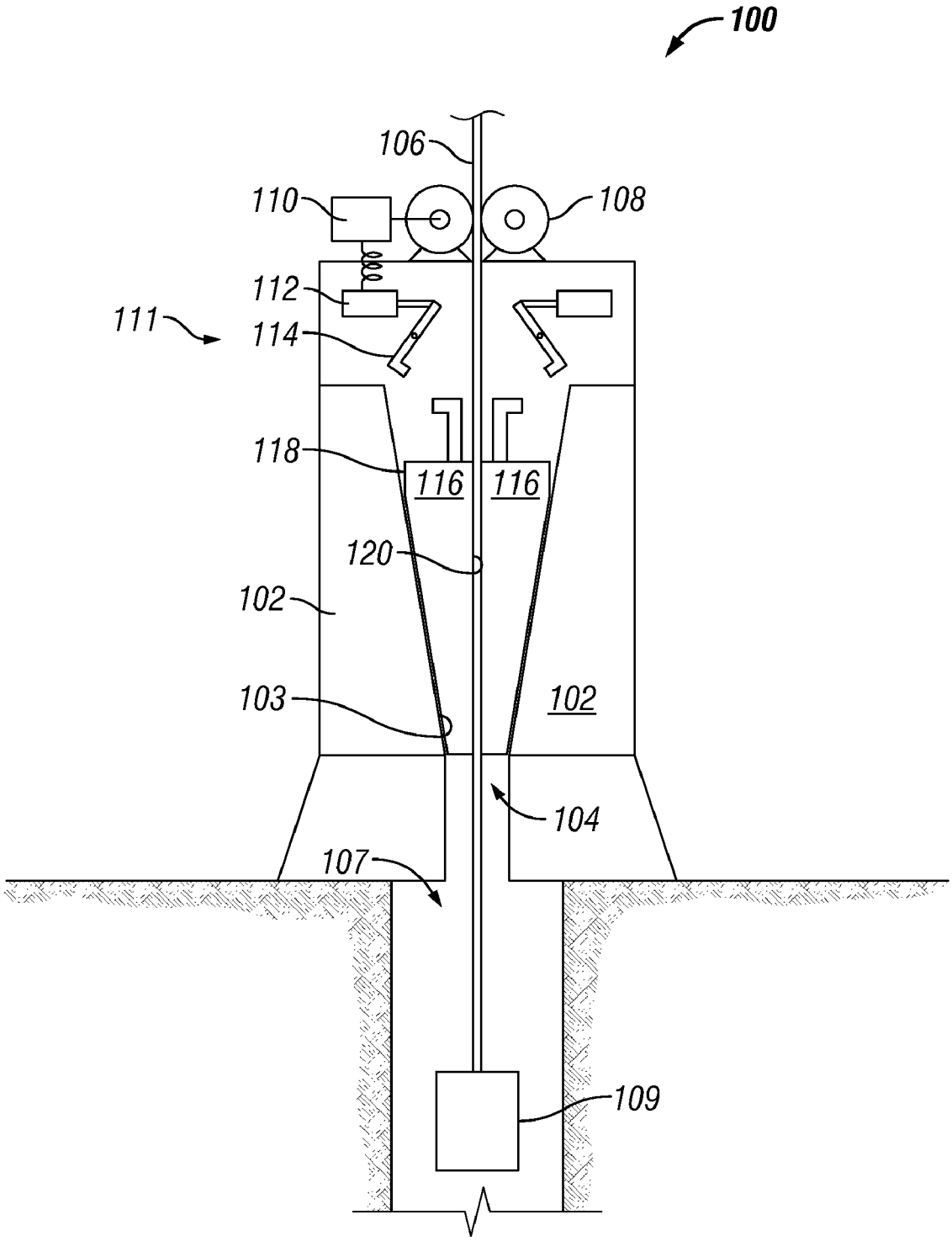
FIG. 2 is a schematic view of an embodiment of a spooled device retaining system shown in an engaged position.

The system 100 is preferably placed around the spooled device, such as the wireline cable 106 that has already been placed in the wellbore 107. The grippers 116 are offset from the cable 106 by a small, preferably predetermined distance in the unreleased position of FIG. 1, and are held into the unreleased position by the release mechanism 114. In the embodiment of FIGS. 1 and 2, the speed and acceleration of the cable 106 is measured by the wheels 108 and encoder 110. The wheels 108 are in firm contact with the exterior surface of the cable 106, and therefore move at the same speed as the cable 106. The encoder 110 preferably converts the speed of the wheels 108 into an electrical output that is proportional to the wheel speed. A controller 130, best seen in FIG. 3, such as a logic device, microprocessor, or the like, preferably compares this electrical output from the encoder 110 to a threshold value that is internally stored in the controller 130 or logic device. The output of the encoder 110 is a measurement of a condition of the system 100 and the threshold value may correspond to a failure condition of the system 100.

Figure 3:
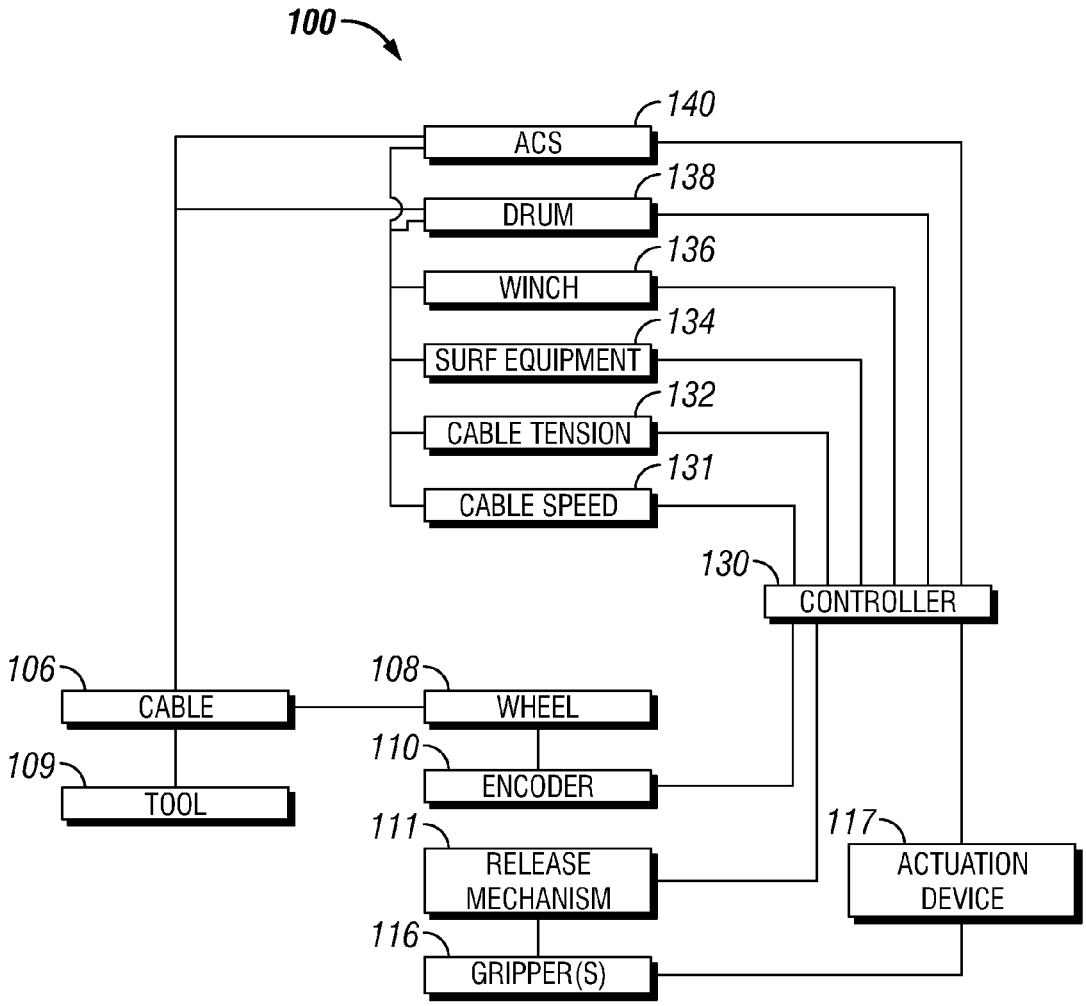
FIG. 3 is a block diagram of an embodiment of a spooled device retaining system.

If the encoder 110 outputs a value greater than the threshold value, the controller 130 or logic device actuates a relay or similar device, which in turn activates the release mechanism 111, such as the solenoid 112. The solenoid 112 is connected to the release arms 114 and the activation of the solenoid 112 causes the release arms 114 to disengage from the grippers 116 (such as by pivoting the arms to the release position shown in FIG. 2) and allow the grippers 116 to move to the engaged or released position shown in FIG. 2. The grippers 116 may be directed towards the cable 106 by application of a force by an actuation device 117, best seen in FIG. 3, such as by compressed springs, a pneumatic or hydraulic cylinder, or the like. The actuation device 117 may be any suitable device having potential energy for providing a force to the grippers 116. The actuation device 117 may receive a signal from the controller 130, as shown in FIG. 3, as will be appreciated by those skilled in the art. Alternatively or in addition to the actuation device 117, the grippers 116 move to engage with the spooled device or cable 106 via gravity.

The grippers 116 are wedged between the cable 106 and housing 102, where a normal force is applied to the exterior surface of the spooled device or cable 106. This normal force results in a frictional force onto the cable 106, which acts in a direction opposite the direction of cable travel. This frictional force also results in a substantially equal and opposite force onto the grippers 116, which further forces the gripper or grippers 116 into the cable 106, thereby increasing the normal force onto the cable 102. The normal force onto the cable 106 is primarily dictated by the coefficient of friction between the grippers 116 and cable 106 and an angle of the exterior surface 118 of the gripper 116 with respect to the interior surface 103 of the housing 102. The angle between the surfaces 118 and 103 may be designed such that the grippers 116 apply a normal force resulting in a frictional force that is equal to the tension force applied to the cable 106, regardless of the value of this tension. Due to this relationship in the tension force of the cable 106 and the normal force of the gripper 116, the system 100 is advantageously self-actuating.

Figure 4:
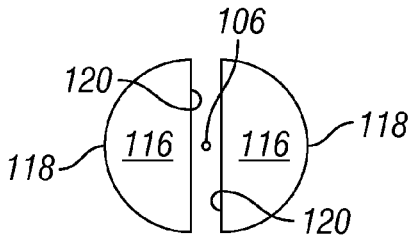
FIG. 4 is a schematic cross sectional view of an embodiment of a gripper.

In an embodiment, the grippers 116 may be formed from a sacrificial material such as, but not limited to, brass, copper, or any type of material that may engage the exterior surface of the spooled device or cable 116 and be abraded or worn less likely causing damage to the exterior surface of the spooled device or cable 106. In an embodiment, the grippers 116 may be formed from a material that does not spark such as, brass, copper, an asbestos-like material, or the like. Those skilled in the art will appreciate that the grippers 116 may be formed from any material suitable for frictionally engaging with the cable 106 without damaging the exterior of the cable 106. As seen in FIG. 4, the grippers 116 may be a pair of grippers 116 and interior surfaces 120 of the grippers 116 may be planar opposed surfaces. The grippers 116 in the embodiment of FIG. 4 are shown having a substantially circular cross section or profile. Those skilled in the art will appreciate that the number of grippers 116 and the cross-section or profile of the grippers 116 may be any suitable number or shape.

Figure 5:
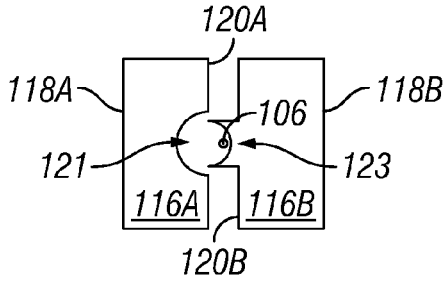
FIG. 5 is a schematic cross sectional view of an embodiment of a gripper.

In an embodiment, best seen in FIG. 5, the grippers 116 may be formed into opposing members **116*a* and 116*b*. The interior surface 120*a* of the gripper 116*a* comprises a concave portion 121 and the interior surface 120*b* of the gripper 116*b* comprises a convex portion 123. When the grippers 116*a* and 116*b* move to the engaged position, the concave portion 121 and the convex portion 123 engage with the exterior surface of the spooled device or cable 106. In the embodiment shown in FIG. 5, the grippers 116*a* and 116*b*** may be able to provide a longer working life, due to the sacrificial nature of the material, as will be appreciated by those skilled in the art.

Advantageously, the grippers 116 of the system 100 do not clamp onto the cable 106 until a failure has been detected by the system 100. The system 100 determines when a failure occurs when the cable 106 velocity and/or acceleration has surpassed beyond a predetermined value that is not less than the maximum intentional velocity and/or acceleration that is dictated by the winch or drum to which the cable 106 is attached. Once the system 100 has determined a failure has occurred, the wedges or grippers 116 are released and travel towards the cable 106 by means of an applied force, which can be accomplished by the actuation device 117, via gravity, or both.

In an embodiment, the speed of the spooled device or cable 106 can be measured by purely mechanical device (such as a flywheel clutch or similar suitable device), that is attached to the wheels 108. Once the rotational velocity of the wheels 108 reaches a threshold value that may correspond to a failure condition of the system 100, the flywheel clutch will engage, which in turn will disengage the release mechanism 111 from the grippers 116. The flywheel clutch may also send a signal to the controller to disengage the release mechanism 111. Suitable devices other than solenoids or flywheel clutches may also be utilized to disengage the grippers 116 and other suitable devices 131, best seen in FIG. 3 may be utilized to measure the cable speed or acceleration, as will be appreciated by those skilled in the art.

A measurement of a condition of the system 100 may also comprise a measurement of the tension of the spooled device or cable 106 utilizing a tension measurement device 132, best seen in FIG. 3. The measurement of the tension in the cable 106 is compared to a threshold value that is internally stored in the controller 130. If a failure in the cable 106 occurs, a corresponding drop in cable tension will also occur. Once the measured cable tension drops below the threshold value, the release mechanism 111 is disengaged from the grippers 116. The threshold value may correspond to a failure condition of the system 100. In such an embodiment, the cable tension may be measured by a cable mounted tension device (CMTD), as will be appreciated by those skilled in the art, or another suitable device or devices for measuring the tension of the spooled device or cable 106.

A situation may occur due to the failure of surface equipment, such as a winch 136 motor failure, a drum 138 brake failure, or the like where the cable 106 speed will increase not due to a failure of the cable 106 but due to the drum 138, winch 136 or surface equipment 134 (i.e., chains, sprockets, brackets, etc) losing control, resulting in the cable 106 and toolstring 109 dropping to the bottom of the well 107. A measurement of a condition of the system 100, therefore, may also comprise a measurement of the condition of auxiliary equipment that controls movement of the spooled device 106 such as a drum 138 on which the spooled device or cable 106 is wound, a winch 136 providing motive power to the drum 138, or other surface equipment 134 (such as a hydraulic power pack or the like) or a signal from the cable 106 via an acquisition control system 140, each of which may send a signal or signals to the controller 130, best seen in FIG. 3. The acquisition control system 140 may also be in communication with the drum 138, the winch 136, and surface equipment 134 and/or receive signals from the cable tension measurement device 132 and the cable speed measurement device 131. Each of the conditions of the system 100 are compared to threshold values in the controller 130, which may then send a signal to the release mechanism 111 if the measured value is greater or lesser than the threshold value or values. The combination provided by the system 100 may allow not only cable 106 break protection but also drum 138 control failure protection and thereby prevent a free wheel condition, where the movement of the drum 138 and cable 106 are not controlled.

Embodiments of the system 100 advantageously prevent a spooled device such as a wireline cable 106 from entering the wellbore 107 (such as due to a failure of the cable 106) by applying a normal force that is perpendicular to the longitudinal axis of the cable 106. This normal force results in a frictional force that is in a direction opposite to the direction of cable travel, that is, into the well 107. The normal force is generated by wedging a piece of material (the gripper or grippers 116) between the cable 106 and the solid structure of the housing 102. The gripper 116 defines an interior surface 120 that is at a small angle relative to the exterior surface of the cable 106. The angle is such that the wedged shaped gripper 116 is forced into the cable 106 by the friction force that is imparted onto the cable 106. The angle is primarily dictated by the coefficient of friction between the cable 106 and the wedged gripper 116. The system 100, therefore, may reduce the likelihood of fishing operations and lost time for the spooled device or cable 106 and toolstring 109.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A system for arresting the progress of a spooled device into a wellbore, comprising:

a housing defining an aperture extending therethrough, the aperture sized for allowing the spooled device to pass therethrough;

a sensor to measure at least one condition of the system;

a controller for determining a failure condition of the system based on the measured system condition; and a gripper device to engage with the spooled device and the housing to prevent the loss of the spooled device when the condition of the system is a failure condition.

2. The system of claim 1 wherein the controller compares the condition of the system with a threshold value to determine the failure condition.

3. The system of claim 1 wherein the gripper device is at least one wedge-shaped gripper for engaging with the interior surface of the housing and the exterior surface of the spooled device to apply a normal force to the spooled device.

4. The system of claim 1 further comprising an actuator for applying a force to the gripper device to allow the gripper device to engage the spooled device and the housing.

5. The system of claim 1 further comprising a release mechanism coupled to the gripper device to allow the gripper device to engage the spooled device and the housing.

6. The system of claim 1 wherein the gripper device comprises a sacrificial material.

7. The system of claim 1 wherein the sensor measures a condition of the spooled device.

8. The system of claim 7 wherein the condition of the spooled device is one of a tension of the spooled device, speed of the spooled device and acceleration of the spooled device.

9. The system of claim 1 wherein the sensor measures a condition of auxiliary equipment for controlling the movement of the spooled device.

10. The system of claim 9 wherein the condition of auxiliary equipment is one of a drum condition, a winch condition, and a surface equipment condition.

11. A method for arresting the progress of a spooled device into a wellbore, comprising:

providing a housing defining an aperture extending therethrough, the aperture sized for allowing the spooled device to pass therethrough;

measuring at least one condition of the system with at least one sensor;

determining a failure condition of the system based on the measured system condition with a controller; and engaging the spooled device and the housing with a gripper device to prevent the loss of the spooled device when the condition of the system is a failure condition.

12. The method of claim 11 wherein determining comprises comparing the condition of the system with a threshold value to determine the failure condition.

13. The method of claim 12 wherein engaging comprises engaging the spooled device and the housing with the gripper device that comprises at least one wedge-shaped gripper for engaging with the interior surface of the housing and the exterior surface of the spooled device to apply a normal force to the spooled device.

14. The method of claim 12 wherein engaging further comprises applying a force to the gripper device with an actuator to allow the gripper device to engage the spooled device and the housing.

15. The method of claim 12 further comprising a release mechanism coupled to the gripper device to allow the gripper device to engage the spooled device and the housing.

16. The method of claim 12 wherein the gripper device comprises a sacrificial material.

17. The method of claim 12 wherein measuring comprises measuring a condition of the spooled device.

18. The method of claim 17 wherein measuring the condition of the spooled device comprises measuring one of a tension of the spooled device, speed of the spooled device and acceleration of the spooled device.

19. The method of claim 12 wherein measuring comprises measuring a condition of auxiliary equipment for controlling the movement of the spooled device.

20. The method of claim 19 wherein measuring the condition of auxiliary equipment comprises measuring one of a drum condition, a winch condition, and a surface equipment condition.

* * * * *